US005413428A

United States Patent [19]

Kageyama

[11] Patent Number: 5,413,428

[45] Date of Patent: May 9, 1995

[54] WRITING INSTRUMENT

[75] Inventor: Shuhei Kageyama, Kawagoe, Japan

[73] Assignee: Kotobuki & Co. Ltd., Kyoto, Japan

[21] Appl. No.: 250,938

[22] Filed: May 31, 1994

Related U.S. Application Data

[63] Continuation of Ser. No. 63,456, May 18, 1993, abandoned, which is a continuation of Ser. No. 863,793, Apr. 6, 1992, abandoned.

[30] Foreign Application Priority Data

May 20, 1991 [JP] Japan ..... 3-035471 U

[51] Int. Cl.[6] ..... B43K 7/12; B43K 24/08

[52] U.S. Cl. ..... 401/110; 401/111; 401/104

[58] Field of Search ..... 401/109, 110, 111, 104

[56] References Cited

U.S. PATENT DOCUMENTS 3,318,289 5/1967 Marynissen ..... 401/110

FOREIGN PATENT DOCUMENTS 1137022 5/1957 France ..... 401/110

3444819 8/1986 Germany ..... 401/109

395791 1/1966 Switzerland ..... 401/111

961246 6/1964 United Kingdom ..... 401/110

964464 7/1964 United Kingdom ..... 401/109

*Primary Examiner*—Steven A. Bratlie

*Attorney, Agent, or Firm*—David O'Reilly

[57] ABSTRACT

A writing instrument including; a front casing having a throughhole extending longitudinally therethrough; a refill extending in the throughhole; and a cam body located in the throughhole. The cam body has at least one cam groove formed on the inner periphery thereof, at least one cam surface provided at the end thereof, and a shoulder portion connecting the cam grooves. A rotating cam engages the edge of the cam grooves and receives an end of the refill. A cam bar having at least one projection is adapted to be inserted in the cam grooves so as to slide along the cam grooves to a shoulder portion. The cam bar is able to push the rotating cam forwardly to cause the rotating cam to rotate. An elastic body pushes the refill toward the rotating cam. rear casing is aligned with the front casing and is fixed at the cam bar.

7 Claims, 2 Drawing Sheets

WRITING INSTRUMENT

This is a continuation of application Ser. No. 08/063,456 filed on May 18, 1993, which is a continuation of application Ser. No. 07/863,793 filed on Apr. 6, 1992, both abandoned.

FIELD OF THE INVENTION

This invention relates to a writing instrument having a rotating cam mechanism and more particularly to a ballpoint pen having the rotating cam mechanism.

BACKGROUND OF THE INVENTION

Certain writing instruments in prior art comprise an outer casing which defines a longitudinal throughhole, a refill extending through the throughhole, a nose cone threadably engaged on the outer casing, and a rear casing is removably inserted into an end of the throughhole.

A cam body is fixed on the outer casing inside the throughhole and has a plurality of cam surfaces and cam grooves. A rotating cam is arranged in the casing throughhole to receive a refill, and is engageable by the edge of the cam grooves. A cam bar is arranged and adapted to push the rotating cam forwardly.

When a user pushes the rear casing forwardly, the longitudinal movement via the cam bar cause the rotating cam to push forwardly and rotate at predetermined angles by the cooperation of the rotating cam and the cam surfaces.

Because the rear casing is removable with respect to the outer casing, however, such an instrument creates the risk that a child may swallow it and suffocate.

In order to eliminate the risk, some prior art instruments are provided with rear casings which have a hole to ensure an air flow introduced therethrough when swallowed. However it is high in cost.

SUMMARY OF THE INVENTION

Accordingly, it is an object of the invention to solve the above disadvantages of prior art writing instruments.

In accordance with the present invention there is provided a writing instrument including; a front casing having a throughhole extending longitudinally there through; a refill extending through the throughhole; and a cam body located in the casing throughhole. The cam body has at least one cam groove formed on the inner periphery thereof, at least one cam surface formed at the end thereof, and a shoulder portion connecting the cam grooves. A rotating cam is engageable with the edge of the cam grooves and receives an end of the refill. A cam bar having at least one projection is adapted to be inserted in the cam grooves so as to slide along the cam grooves until it reaches the shoulder portion. The cam bar is able to push the rotating cam forwardly to cause the rotating cam to rotate with an elastic body pushing the refill toward the rotating cam. A rear casing is aligned with the front casing and is fixed to the cam bar.

The cam body is mounted on the inner periphery of the front casing and has at least one slit extending from the cam surfaces.

The cam body has a flange portion on the outer periphery thereof and the front casing has a recess portion on the inner periphery thereof. The flange portion engages the recess portion so that the cam body is mounted on the front casing.

The rotating cam has an axis portion, with at least one slit and one strip providing a projection on the outer surface, and the cam bar has a cavity so that the rotating cam is mounted on the cam bar.

The rear casing is integrally formed with the cam bar and there are only a few projections on the cam bar which are flexible so that the cam bar can be inserted into the cam body from the rear.

BRIEF DESCRIPTION OF THE DRAWINGS

The invention will be more particularly described with reference to a preferred embodiment as illustrated in the accompanying drawings, in which.

DETAILED DESCRIPTION OF THE INVENTION

Figure 1:
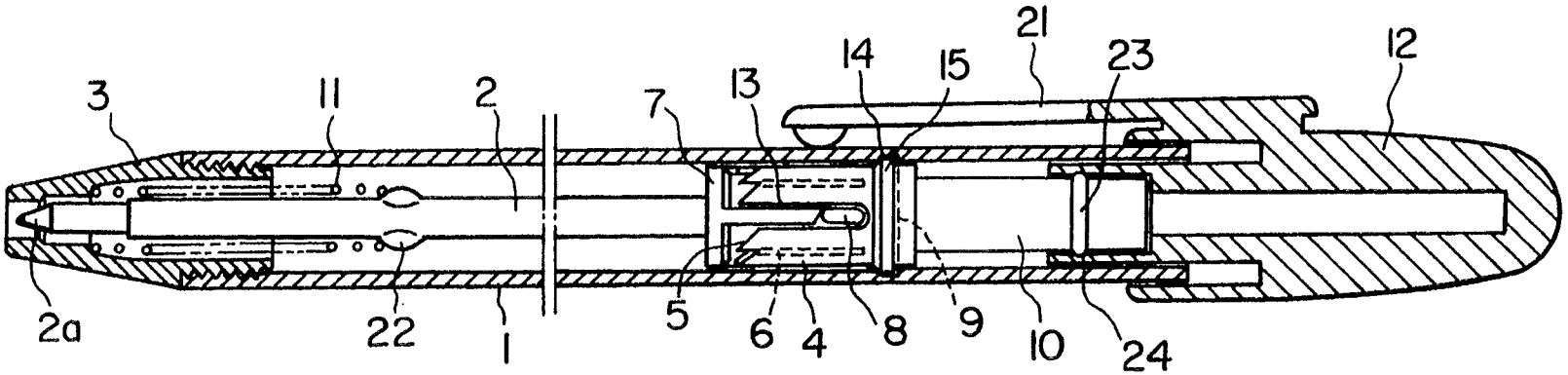
FIG. 1 is a cross-sectional view for explaining a preferred embodiment of the writing instrument according to the present invention.
Figure 2:
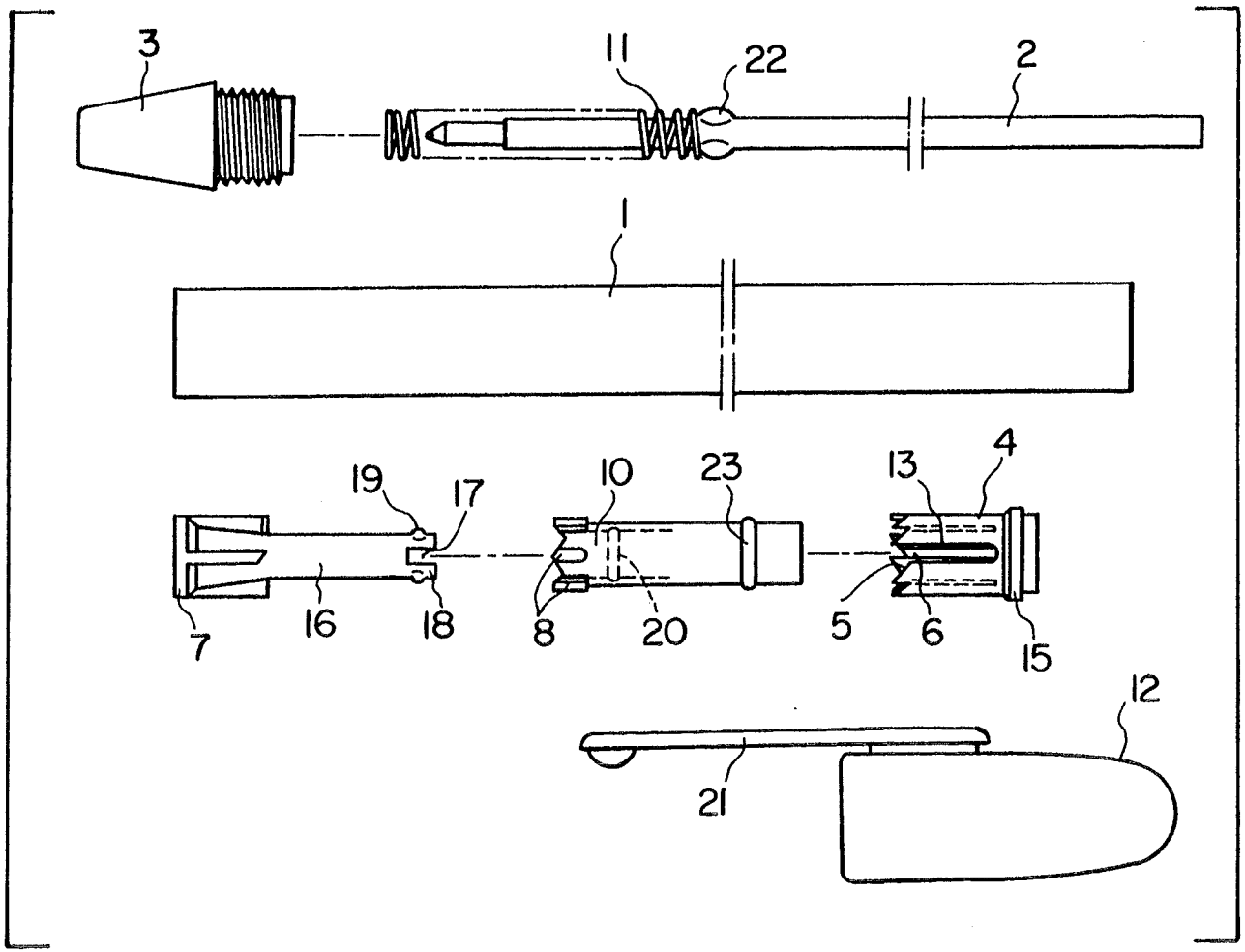
FIG. 2 shows the embodiment of the writing instrument of the present invention in the partially unassembled position.

The embodiment of this invention is an example applied to a ballpoint pen. Referring to FIGS. 1 and 2, the ballpoint pen comprises front casing 1, nose cone 3 and rear casing 12. Front casing 1 is made of an elastomer to be easily and comfortable gripped by a user. Front casing 1 is threadably engaged with the nose cone 3. Front casing 1 and nose cone 3 accommodate refill 2 extending axially therein.

Cam body 4 is provided inside front casing 1. Cam body 4 has a plurality of (for example, three in this embodiment) cam grooves 6 formed on an inner periphery. A plurality of (three in this embodiment) slits 13 are provided between cam grooves 6. At one end of the cam body 4, a plurality of (six in this embodiment) cam surfaces 5 are formed and extend obliquely to the axis of cam body 4 from slits 13 to cam grooves 6 and from cam grooves 6 to slits 13. Cam body 4 also has shoulder portion 9 at the other end, and has flange portion 15 on an outer surface of the cam body which engages annular recess 14 formed on an inner surface of front casing 1 so that cam body 4 is secured on front casing 1.

Rotating cam 7 engages to an edge of cam grooves 6 and slits 13. Rotating cam 7 has axis portion 16 and plurality of slits 17 and strips 18. Two projections 19 are provided on outer surfaces of two of the strips 18.

Cam bar 10 has a plurality of (six in this embodiment) projections 8 at one end thereof, an annular ring 23 formed on an outer periphery thereof, and a cavity 20 formed on an inner periphery thereof. Projections 19 engage cavity 20 so that rotating cam 7 is mounted on cam bar 10 and can rotate via cam bar 10. Also, three of projections 8 are adapted to slidably engage three of cam grooves 6 and the other three of projections 8 are adapted to slidably engage three of slits 13.

Cam body 4, rotating cam 7 and cam bar 10 provide a conventional rotating cam mechanism.

Refill 2 extends axially through a throughhole in the front casing 1 and nose cone 3. Refill 2 has a writing tip **2*a* at the end thereof and spring stop 22 outside thereof. Spring 11 is provided between nose cone 3 and spring stop 22 to push refill 2 rearwardly. The other end of refill 2 is inserted into rotating cam 7 and maintained by rotating cam 7**.

An end of rear casing 12 is inserted into the through-hole of front casing 1. Clip 21 is integrally fixed to rear casing 12 and extends longitudinally from rear casing 12 along outside of the front casing 1. On inner side of the end of rear casing 12 a groove 24 is provided which engages ring 23 of cam bar 10 so that rear casing 12 is fixedly mounted to cam bar 10.

Alternatively, rear casing 12 may be integrally secured to cam bar 10. In that case, the number of projections 8 may be decreased preferably to one or two and may be more flexible so that cam bar 10 can be easily inserted into cam body 4.

In operation, when an user pushes rear casing 12 axially toward front casing 1, rotating cam 7 is pushed against the spring force by projections 8 which slide cam grooves 6 or slits 13. Rotating cam 7 disengages from slits 13 and engages the edge of cam grooves 6 through cam surfaces 5. Every time a user pushs rear casing 12, rotating cam 7 engages the edge of cam grooves 6 to slits 13, or is engaged from slits 13 to cam grooves 6. Therefore totaling cam 7 rotates through a predetermined angle, i.e. 60 degrees in this embodiment. When rotating cam 7 engages the edge of cam grooves C, rotating cam 7 is pushed forwardly to cause tip 2*a* of refill 2 to extend forwardly out of nose cone 3 against the spring force. When rotating cam 7 disengages from cam grooves 6, rotating cam 7 and thus refill 2 are retracted backwardly into the front casing 1 and cone nose 3 by the spring force.

Since cam bar 10 is fixedly secured to rear casing 12 by engagement between ring 23 and groove 24, rear casing 12 is never separated from the body of the ball-point pen therefore it eliminates the risk that a child may swallow it and suffocate.

This invention is not to be limited by the embodiment shown in the drawings and described in the description which is given by way of example and not of limitation, but only in accordance with the scope of the appended claims.

We claim:

1. A writing instrument including;

a tubular front casing having a constant diameter through-hole extending longitudinally therethrough, said tubular front casing having an annular recess in an interior periphery thereof;

a refill inserted in said through-hole in said tubular front casing, a cam mechanism for extending and retracting said refill from a nose cone on said tubular front casing, said cam mechanism comprising;

a cam body located in said through-hole in said tubular front casing, said cam body having a plurality of cam grooves formed on an inner surface alternating with a plurality of cam slits, said plurality of alternating cam grooves and cam slits terminating at a shoulder portion at the end of said cam body;

said cam body having a plurality of cam surfaces on an end adjacent to said plurality of alternating cam grooves and cam slits and a flange on the other end , said flange constructed to engage said annular recess on the interior periphery of said casing;

a rotatable cam, having a plurality of cam surfaces engageable with said plurality of cam surfaces and cam slits on said cam body, said rotatable cam fitting over and engaging an end of said refill;

connecting means on an axis portion of said rotatable cam;

a cam bar having a plurality of projections constructed to slidably engage said plurality of alternating cam grooves and cam slits up to said shoulder portion, said plurality of projections on said cam bar constructed to engage said plurality of cam surfaces on said rotatable cam to push said rotatable cam in an axial direction to alternately disengage and re-engage said plurality of cam surfaces on said rotatable cam with said plurality of slits in said cam body;

connection receiving means on said cam bar for receiving said connecting means on said rotatable cam to mount and retain said cam bar on said rotatable cam; resilient elastic means pushing said refill toward and into engagement with said rotatable cam; and a rear casing mounted on the end of said tubular front casing, said rear casing being secured to said cam bar.

2. The writing instrument according, to claim 1, in which said cam bar is integrally formed on said rear casing, said plurality of projections on said cam bar being deformable so that said cam bar may be inserted in said cam body from the rear.

3. The writing instrument, according to claim 1, in which said connecting means on said rotatable cam comprises at least one slit in said axis portion forming at least one deformable portion on an end of said rotatable cam, said at least one deformable portion having at least one mounting projection; said connection receiving means on said cam bar comprising an interior annular cavity; said at least one mounting projection engaging said interior annular cavity to mount and retain said cam bar on said rotatable cam.

4. A writing instrument comprising;

a hollow tubular front casing, said hollow tubular front casing having an annular recess on an interior periphery portion thereof;

a nose cone attached to a forward end of said hollow tubular front casing;

a writing refill inserted in said hollow tubular front casing for extending out of and retracting into said nose cone;

a cam mechanism for extending and retracting said refill from said nose cone on said tubular front casing, said cam mechanism comprising;

a cam body located in said hollow tubular front casing, said cam body having a plurality of cam grooves formed on an inner surface alternating with a plurality of cam slits, said plurality of alternating cam grooves and cam slits terminating at a shoulder portion at the end of said cam body;

said cam body having a plurality of cam surfaces on an end adjacent to said plurality of alternating cam grooves and cam slits and a flange on the other end, said flange constructed to engage said annular recess on the interior periphery of said casing;

a rotatable cam, having a plurality of cam surfaces selectively engageable with said plurality of cam surfaces and cam slits in said cam body, said rotatable cam fitting over and engaging an end of said refill;

connecting means on an axis portion of said rotatable cam;

a cam bar having a plurality of projections constructed to slidably engage said plurality of alternating cam grooves and cam slits up to said shoulder portion, said plurality of projections on said cam bar constructed to engage said plurality of cam surfaces on said rotatable cam to push said rotatable cam in an axial direction to alternately disengage and re-engage said plurality of cam surfaces on said rotatable cam with said plurality of slits in said cam body;

connection receiving means on said cam bar for receiving the connecting means on said rotatable cam to mount and retain said cam bar on said rotatable cam; resilient biasing means for pushing said writing refill rearward toward said rotating cam; and rear casing means fitted on the other end of said front casing opposite said nose cone, said rear casing means being fixedly attached to said cam bar.

5. The writing instrument according to claim 4 wherein said cam body is mounted on an interior periphery of said hollow tubular front casing, said cam body having at least one longitudinal slit.

6. The writing instrument according to claim 4 wherein said cam bar is integrally formed on said rear casing means; said plurality of projections being on a deformable portion of said cam bar so that said cam bar with said rear casing means can be inserted in said cam body from the rear.

7. The writing instrument, according to claim 4, in which said connecting means on said rotatable cam comprises at least one slit in said axis portion forming at least one deformable portion on an end of said rotatable cam, said at least one deformable portion having at least one mounting projection; said connection receiving means on said cam bar comprising an interior annular cavity; said at least one mounting projection engaging said interior annular cavity to mount and retain said cam bar on said rotatable cam.

* * * * *